US007800508B2

(12) United States Patent
Chian et al.

(10) Patent No.: US 7,800,508 B2
(45) Date of Patent: Sep. 21, 2010

(54) DYNAMIC DC BIASING AND LEAKAGE COMPENSATION

(75) Inventors: Brent Chian, Plymouth, MN (US); John T. Adams, Aran (CH); Timothy J. Nordberg, Plymouth, MN (US); Bruce Hill, Roseville, MN (US); Peter M. Anderson, Minneapolis, MN (US)

(73) Assignee: Honeywell International Inc., Morristown, NJ (US)

( * ) Notice: Subject to any disclaimer, the term of this patent is extended or adjusted under 35 U.S.C. 154(b) by 1532 days.

(21) Appl. No.: 10/908,463

(22) Filed: May 12, 2005

(65) Prior Publication Data

US 2006/0257804 A1 Nov. 16, 2006

(51) Int. Cl.
*G08B 17/12* (2006.01)

(52) U.S. Cl. ..... 340/577; 340/578; 340/600; 431/24

(58) Field of Classification Search ..... 340/577–584, 340/693, 511, 507, 660–664, 593, 600; 431/24, 431/6

See application file for complete search history.

(56) References Cited

U.S. PATENT DOCUMENTS

| | | | | |
|---|---|---|---|---|
| 3,909,816 | A | 9/1975 | Teeters | |
| 4,157,506 | A | 6/1979 | Spencer | |
| 4,221,557 | A | 9/1980 | Jalics | |
| 4,370,557 | A * | 1/1983 | Axmark et al. | 250/554 |
| 4,483,672 | A | 11/1984 | Wallace et al. | |
| 4,655,705 | A | 4/1987 | Shute et al. | |
| 4,695,246 | A | 9/1987 | Beilfuss et al. | |
| 4,830,601 | A | 5/1989 | Dahlander et al. | |
| 4,842,510 | A | 6/1989 | Grunden et al. | |
| 4,872,828 | A | 10/1989 | Mierzwinski | |
| 4,955,806 | A | 9/1990 | Grunden et al. | |
| 5,037,291 | A | 8/1991 | Clark | |
| 5,077,550 | A | 12/1991 | Cormier | |
| 5,112,117 | A | 5/1992 | Ripka et al. | |
| 5,126,721 | A | 6/1992 | Butcher et al. | |

(Continued)

FOREIGN PATENT DOCUMENTS

EP 0967440 12/1999

(Continued)

OTHER PUBLICATIONS www.playhookey.com, "Series LC Circuits," 5 pages, printed Jun. 15, 2007.

*Primary Examiner*—Anh V La
(74) *Attorney, Agent, or Firm*—Crompton Seager Tufte LLC

(57) ABSTRACT

A system for adjusting a bias voltage of a flame sensing system. The system may use pulse width modulation to adjust the bias voltage. The system may have a flame sensing rod that conveys an electrical equivalent circuit of a flame presence to a detector via low pass filter. An excitation voltage may be conveyed via a DC blocking mechanism to the sensing rod. A pulse width modulation signal may be conveyed via a bias resistor to a node of the low pass filter and the detector. The input of an A/D converter may be that of the detector for flame signals. Also, leakages between the node of the A/D converter connection and the voltage source and/or ground may be detected and compensated. Further, leakage of the DC blocking mechanism may be minimized.

29 Claims, 8 Drawing Sheets

U.S. PATENT DOCUMENTS

| | | | | | |
|---|---|---|---|---|---|
| 5,158,477 | A | | 10/1992 | Geary | |
| 5,222,888 | A | | 6/1993 | Jones et al. | |
| 5,236,328 | A | | 8/1993 | Tate et al. | |
| 5,280,802 | A | | 1/1994 | Comuzie, Jr. | |
| 5,347,982 | A | | 9/1994 | Binzer et al. | |
| 5,365,223 | A | * | 11/1994 | Sigafus | 340/693.1 |
| 5,391,074 | A | | 2/1995 | Meeker | |
| 5,424,554 | A | | 6/1995 | Marran et al. | |
| 5,472,336 | A | * | 12/1995 | Adams et al. | 431/6 |
| 5,506,569 | A | | 4/1996 | Rowlette | |
| 5,567,143 | A | | 10/1996 | Servidio | |
| 5,797,358 | A | | 8/1998 | Brandt et al. | |
| 5,971,745 | A | | 10/1999 | Bassett et al. | |
| 6,060,719 | A | | 5/2000 | DiTucci et al. | |
| 6,084,518 | A | | 7/2000 | Jamieson | |
| 6,222,719 | B1 | | 4/2001 | Kadah | |
| 6,299,433 | B1 | | 10/2001 | Gauba et al. | |
| 6,509,838 | B1 | | 1/2003 | Payne et al. | |
| 6,743,010 | B2 | | 6/2004 | Bridgeman et al. | |
| 6,794,771 | B2 | | 9/2004 | Orloff | |
| 2002/0099474 | A1 | | 7/2002 | Khesin | |
| 2003/0064335 | A1 | | 4/2003 | Canon | |
| 2004/0209209 | A1 | | 10/2004 | Chodacki et al. | |

FOREIGN PATENT DOCUMENTS

| | | |
|---|---|---|
| EP | 1148298 | 10/2001 |
| WO | 9718417 | 5/1997 |

* cited by examiner

DYNAMIC DC BIASING AND LEAKAGE COMPENSATION

BACKGROUND

The present invention pertains to biasing circuitry, and particularly to DC biasing. More particularly, the invention pertains to DC biasing and leakage detection for sensors.

The present application is related to the following indicated patent applications: entitled "Leakage Detection and Compensation System", U.S. application Ser. No. 10/908,465, filed May 12, 2005; entitled "Flame Sensing System", U.S. application Ser. No. 10/908,466, filed May 12, 2005; and entitled "Adaptive Spark Ignition and Flame Sensing Signal Generation System", U.S. application Ser. No. 10/908,467, filed May 12, 2005; which are all incorporated herein by reference.

SUMMARY

The invention is an approach for adjustable DC biasing, current leakage detection, and leakage compensation in flame sensing circuits.

DESCRIPTION

Figure 1A:
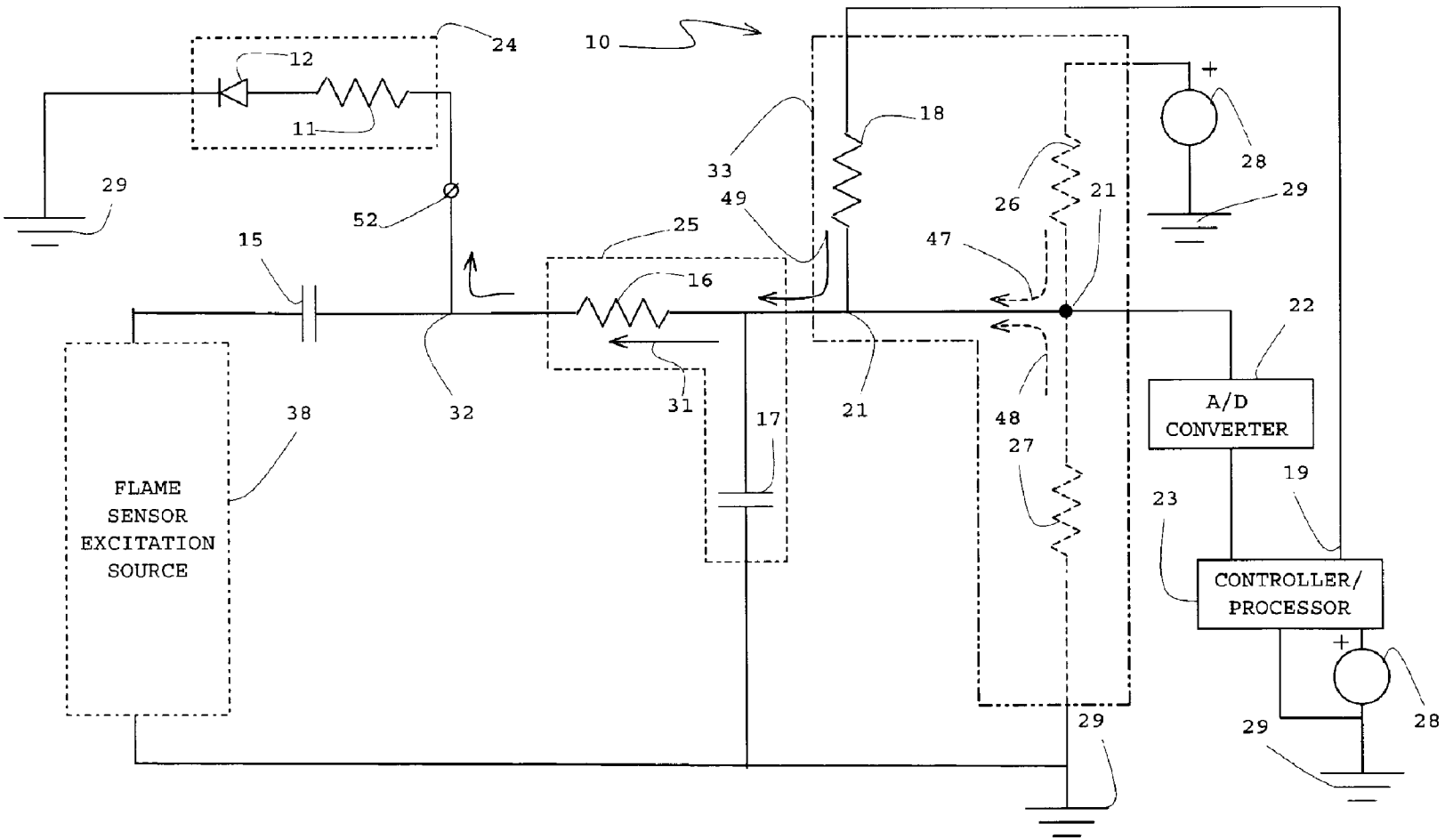
FIG. 1*a* reveals an example of a dynamic DC biasing circuit.

A rectification type flame sensing in a residential combustion system normally generates a negative flame current (i.e., current flowing out from the control circuit to the flame sensing rod) when the flame is present. For a microprocessor controlled flame sensing system to measure the flame current with an analog-to-digital (A/D) converter, the flame current may be converted to a flame voltage by using a flame load resistor or capacitor. The flame sensing input may also need to be biased to a known potential equal to or higher than a ground potential. Then when a flame current exists, it may pull the A/D input to a lower voltage potential. The flame current may be measured by measuring a voltage potential change generated by the flame current. The flame current to be sensed may normally be very low, i.e., the sub-micro ampere range. At this low current level, the resistors used to convert the current to voltage for measuring, and to bias the measuring circuit, may normally be of high resistance and thus be susceptible to DC leakage. To make this problem more difficult, modern electronic technology may demand the use of smaller, tighter space, surface mounted components, making leakage in the circuits even more difficult to prevent. The present invention may provide an approach to detect and/or compensate for DC leakage from components of flame sensing circuits that use excitation signals with a changing or dynamic DC offset or bias.

One approach may use a pulse width modulation (PWM) output from a microprocessor input/output (I/O) pin to control the DC bias level for an A/D input. The DC bias level may be dynamically modified during run time by changing the duty cycle of the PWM signal. Another approach is to change a flame loading equivalent resistance by using a "tri-state PWM" having low and high states, and a high impedance state. Still another may be a digital-to-analog (D/A) converter connected to the processor 23 for providing the DC bias voltage. There may other approaches of providing a dynamic DC bias level or voltage. What may be sought is a control of the DC bias voltage which can be used to determine leakage current and/or to compensate for the leakage.

The benefits of the noted DC leakage control approaches may be indicated in the following. The bias level may be adjusted to increase the dynamic range of the measuring circuit. The dynamic bias scheme may use a single lower impedance resistor instead of a static bias scheme using a few resistors of higher impedance, thereby reducing leakage sensitivity. The dynamic bias may provide the current to match the flame signal and keep the A/D input at a constant voltage, further lowering the impedance of the flame sensing circuit. The leakage resistance may be measured, so that its shunting effect may be removed to achieve higher flame sensing accuracy. An equivalent flame current loading resistance may be adjusted with the "tri-state PWM" to change the sensitivity of the flame current measurement.

Leakage across a single DC-blocking capacitor may demonstrate problems for flame sensing systems in conditions where leakage exists. The leakage may cause the measured flame signal to be incorrect depending on the excitation signal used and the magnitude of the leakage across the DC-blocking capacitor. To prevent current leakage across a DC-blocking capacitor from producing a false flame signal, a "T network" may be used to replace a single capacitor circuit to block the DC component of the flame excitation signal. Depending on the ability to control the flame excitation source, several schemes may be used to cancel out the leakage effect of a DC blocking circuit.

FIG. 1*a* reveals a dynamic DC biasing circuit 10. There may be a flame sensor excitation source 38 connected across a ground terminal 29 and to one terminal of a capacitor 15. Capacitor 15 may be a DC blocking device. The other terminal of capacitor 15 may be connected to one end of a resistor 16. The other end of resistor 16 may be connected to one end of a bias resistor 18, to one end of a capacitor 17, and to node 21 that may be connected to an input of an analog-to-digital (A/D) converter 22. Resistor 16 and capacitor 17 may, for example, have values of 590 kilo-ohms and 0.1 microfarad, respectively. Resistor 18 may, for instance, be about 232 kilo-ohms. The other end of capacitor 17 may be connected to the ground terminal 29. The other end of resistor 18 may be connected to a lead 19 that provides a PWM (pulse width modulation) signal from a microcontroller 23. The PWM signal is just one of the possible ways to provide a variable DC biasing voltage. Resistor 18 may convey a current 49. Microcontroller 23 may be connected to a voltage source ($V_{cc}$) 28 and the ground terminal 29. The converter 22 and microcontroller 23 may be an indicator of a flame sensed or not sensed, and the magnitude of the flame if sensed.

The resistance, designated by a dashed-line resistor symbol 26, with one end connected to node 21 and the other end connected to the voltage source 28, may represent the leakage resistance (which provides the path for leakage current 47) from the voltage source 28 to node 21. The resistance, designated by a dashed-line resistor symbol 27, with one end connected to line 21 and the other end connected to the ground terminal 29, may represent the leakage resistance (which provides the path for leakage current 48) from the ground terminal 29 to node 21. The A/D converter 22 may be connected to node 21 and the microcontroller 23.

There may be a flame model network 24 that is represented by a flame resistance 11 and a flame diode 12. Resistance 11 may be in a range from 1 megohm to 200 megohms. The network 24 represents a simplified equivalent circuit of the flame. If no flame is present, then the network or equivalent circuit 24 may disappear and the network may become an open circuit. With the presence of a flame, the flame resistance 11 may have one end connected to the flame rod 52 which has a connection between capacitor 15 and resistor 16. The other end of the flame resistance 11 may be connected to the anode of diode 12. The cathode of diode 12 may be connected to a ground terminal 29.

Figure 1B:
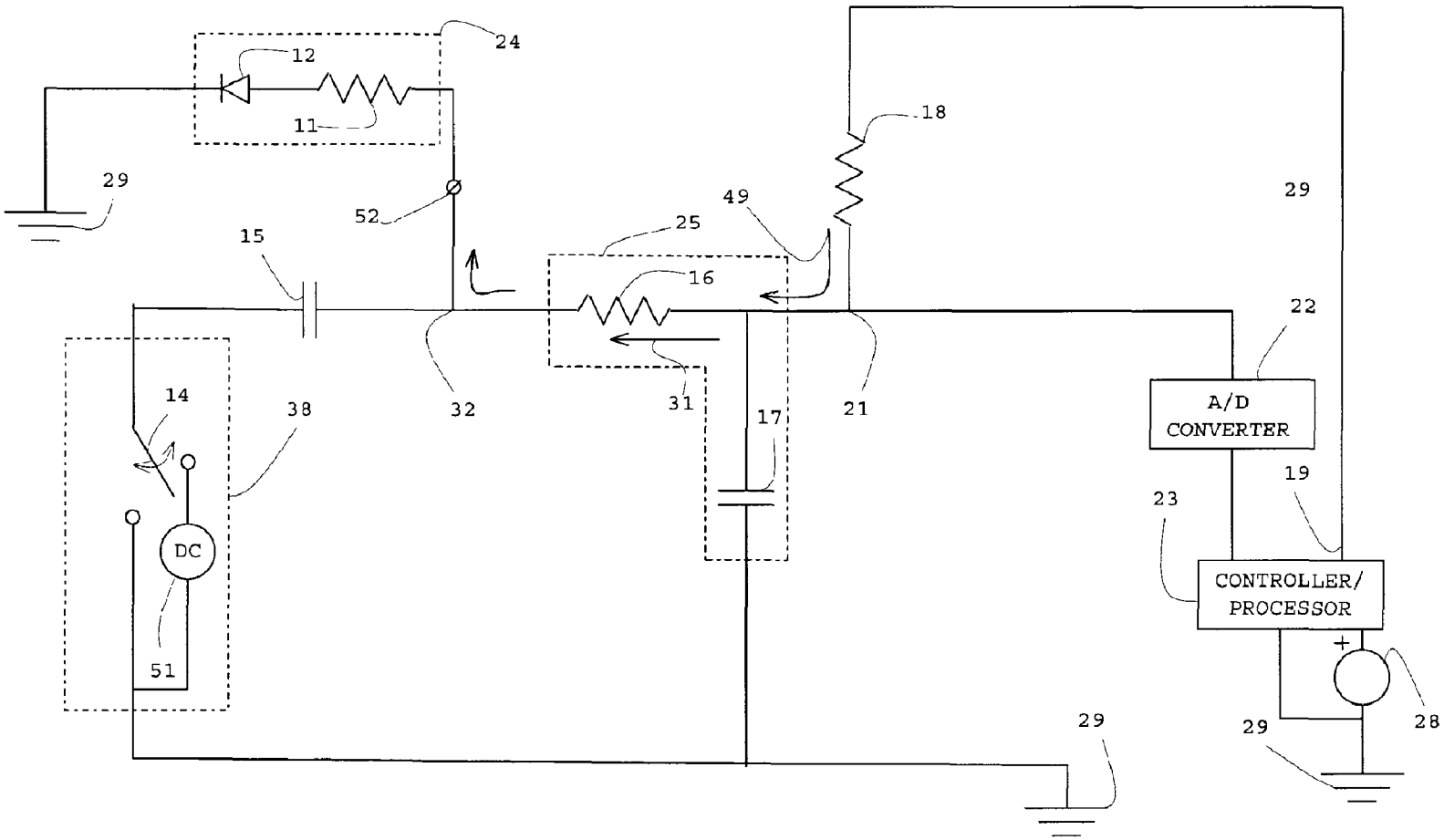
FIG. 1*b* shows an example of a flame excitation source.
Figure 2A:
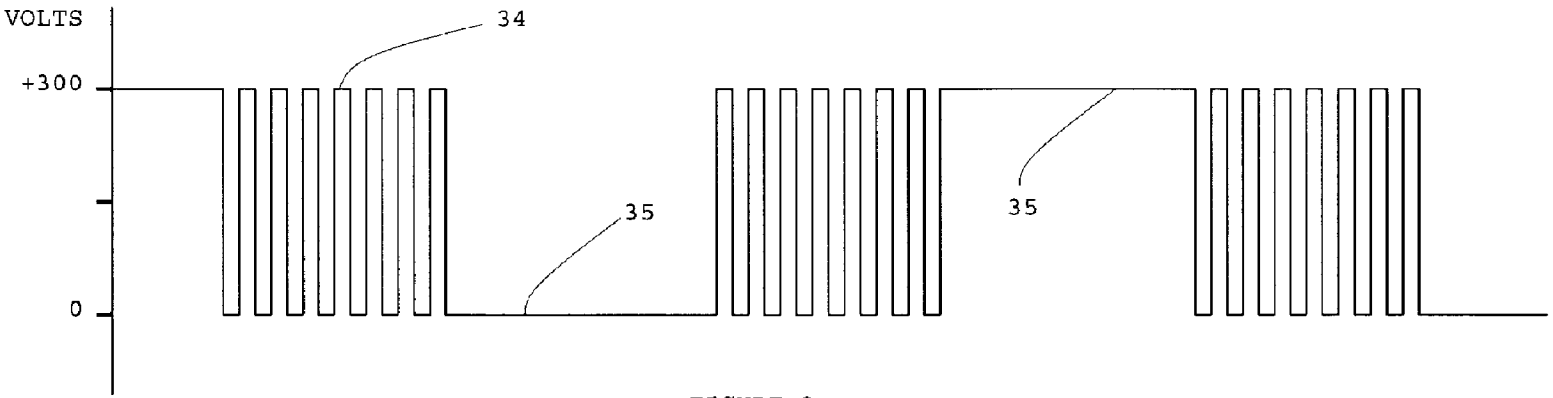
FIGS. 2*a*-2*f* show examples of flame excitation and sensing signals, respectively.
Figure 2B:
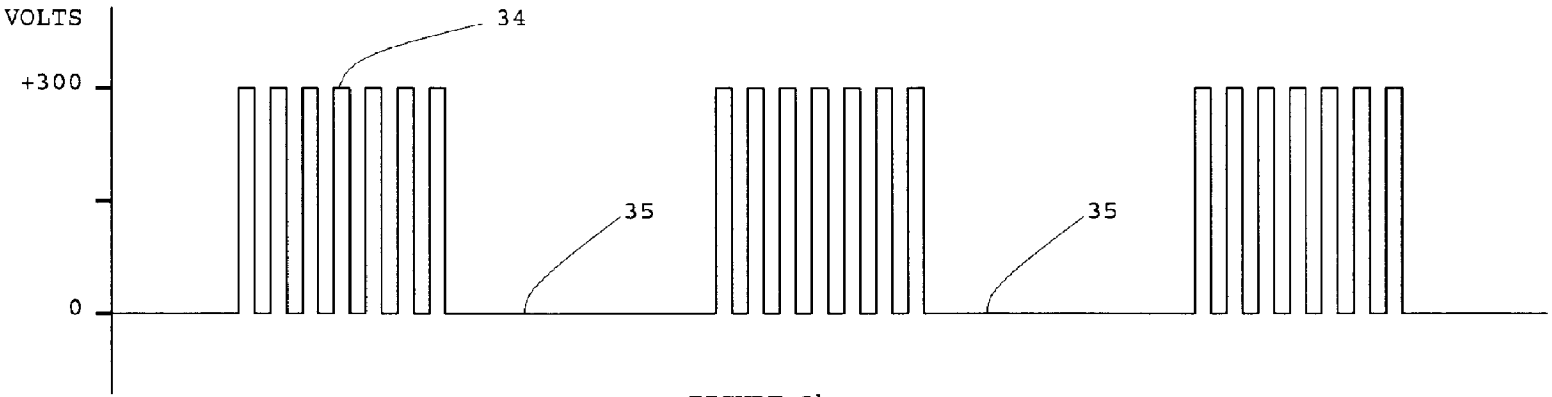
Figure 2C:
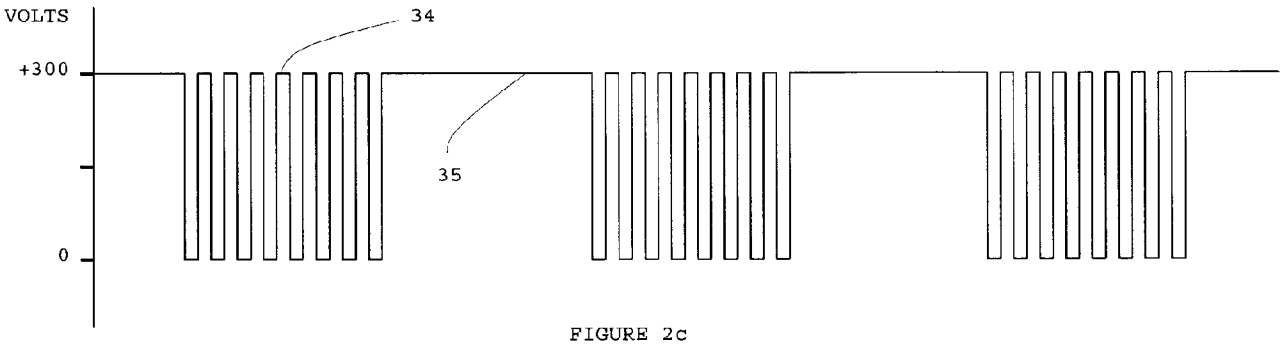
Figure 2D:
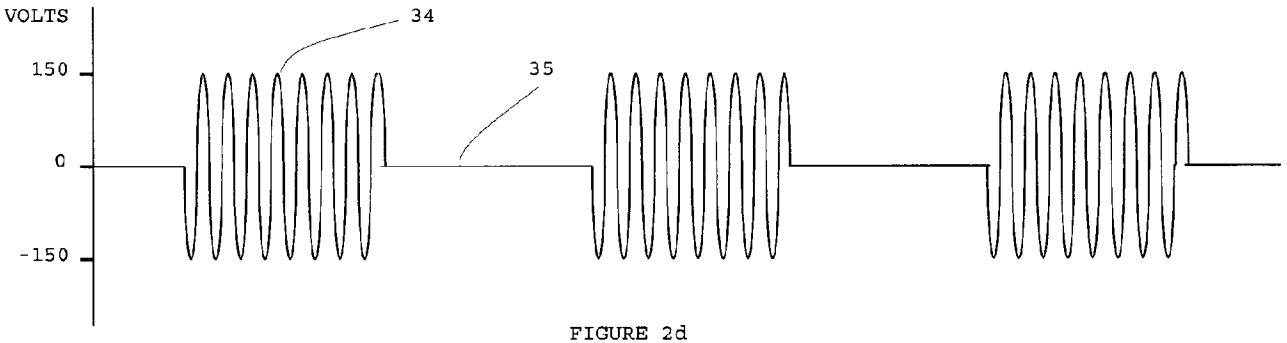
Figure 4:
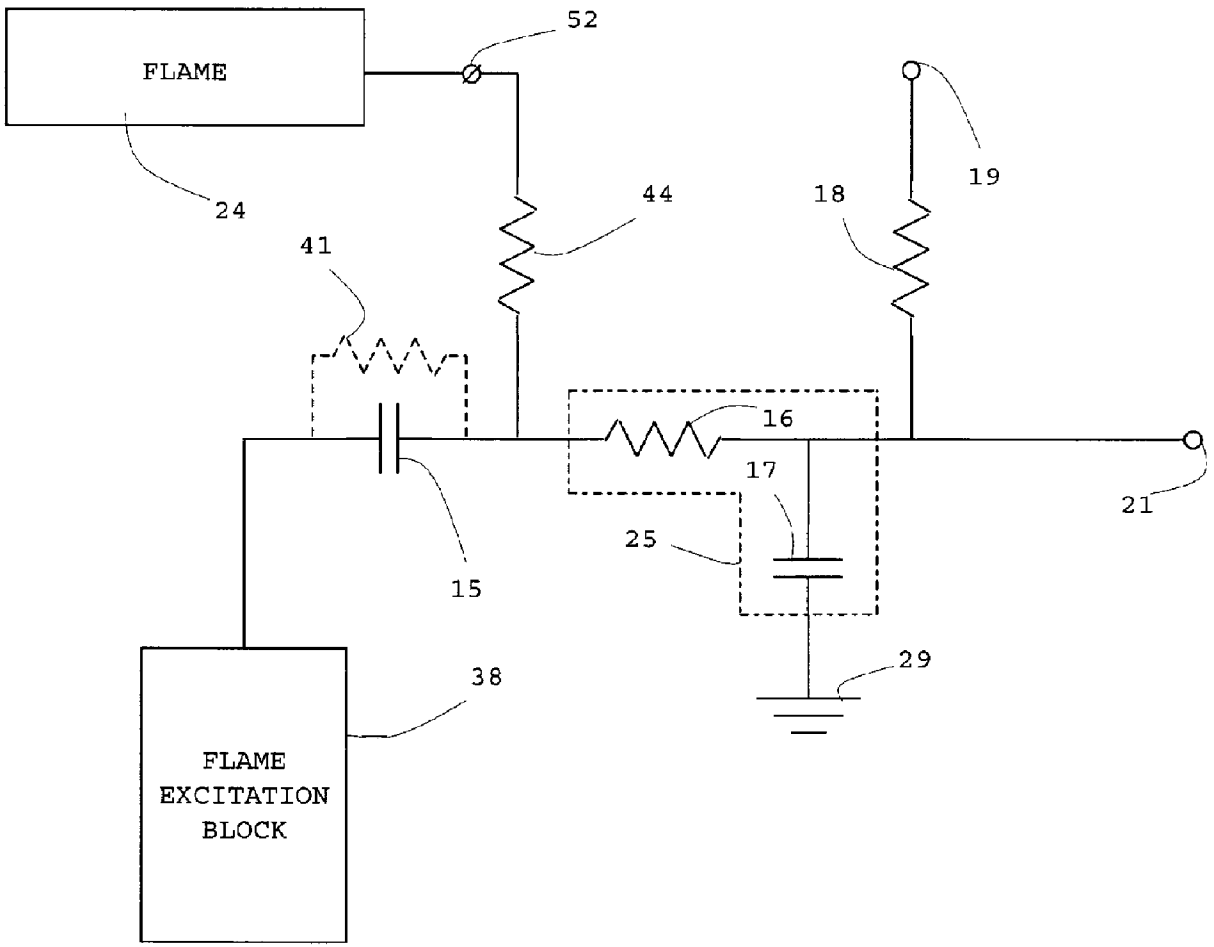
FIG. 4 is a schematic of a flame sensing circuit.

Resistor 11 and diode 12 may represent a flame rectifier when a flame exists. If a flame does not exist, the rectifier network becomes disconnected. There may be a DC power source 51 (e.g., 300 volts) as shown in FIG. 1*b*. Switch 14 may alternate between the (high) voltage power source 51 and a low voltage (or ground 29) at a frequency of about, for example, 2.4 KHz. Switch 14 may represent a chopper circuit. The source 51 and switch 14 may constitute a flame excitation module 38. Capacitor 15 may be used to block DC current to or from the excitation module 38. Examples of a signal output of module 38 are shown in FIGS. 2*a*, 2*b* and 2*c*. The signal in FIG. 2*a* may contain a sequence of, for example, periods 34 of square waves having high and low peaks at a about 300 and zero volts, which may be regarded as a chopped voltage, interspersed with a period 35 of a steady low voltage and period 35 of a steady high voltage, such as about zero volts and about 300 volts, respectively, in an alternating fashion between each period 34. Period 35 may be regarded as a "rail". There may be high rails, low rails, middle rails, half rails, and other rails depending on the magnitude or voltage of the period 35. To achieve the wave pattern of the block 38 output, switch 1 4 may be effectively be a chopping circuit that connects the DC voltage source and then ground 29 to output the waveforms of FIGS. 2*a*-2*c*. In FIG. 2*b*, the periods 35 may be a low voltage with the periods 34 like those of FIG. 2*a*. In FIG. 2*c*, the periods 35 may be a high voltage with periods 34 like those of FIG. 2*a*. In FIG. 2*d*, the periods 34 may instead be a sine wave having a peak to peak voltage of −150 to +150 volts, with a steady voltage of about zero or so volts at periods 35 between the periods 34. An excitation module 38, shown in FIG. 2*g*, may used for generating the waveform shown in FIG. 2*d*. Generator 55 may provide the AC portion of the waveform and generator 51 may provide the DC portion. The signal output of source 38 may have various other kinds and sequences of voltage patterns and magnitudes for the periods 34 and 35. At node 32 of FIGS. 1*a* and 1*b*, the signal of FIGS. 2*a*-2*d*, such as that of FIG. 2*d*, may result in signal shown in FIG. 2*e* on the other side of DC blocking capacitor 15 when flame exists between the sensing rod 52 and ground 29. The signals from the excitation source 38, like those in FIGS. 2*a* and 2*d*, may be used to alleviate leakage across capacitor 15. These excitation signals may be used in a configuration having no "T network" as shown in FIGS. 1*a*, 1*b* and 4. In general, any of these signals may also be used with or without a "T network" (as shown for example in FIG. 5). The "T network" may be robust relative to DC leakage.

Figure 2E:
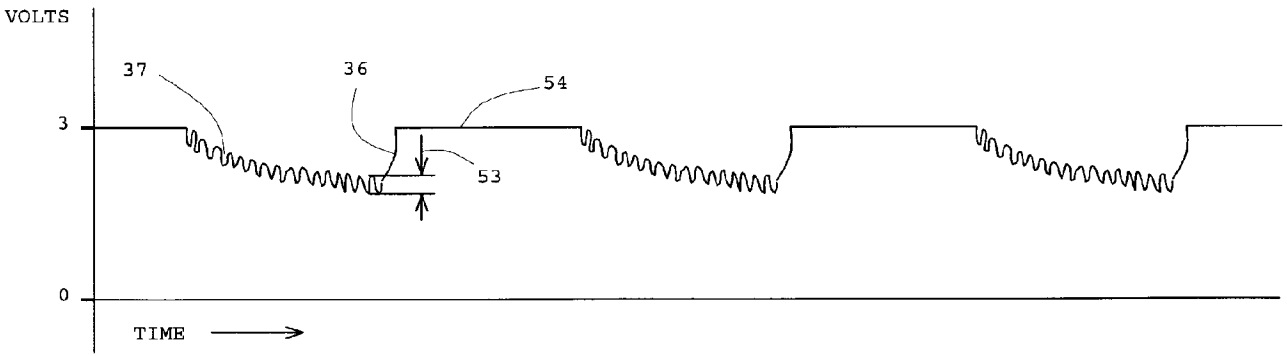

Resistor 16 and capacitor 17 may form a low pass filter 25 to remove or reduce an AC component from the flame signal. FIG. 2*e* shows a sequence of flame signals 36 with decay periods 37 at a node or connection 21. Periods 37 may have a ripple 53. These signals and periods may be superimposed on a DC bias voltage 54 of, for example, 3 volts. If the flame signal 36 is without a bias voltage, then the flame signal may be difficult to detect because a voltage of interest may be below ground level. Bias resistor 18 and a bias PWM signal (or other controllably variable voltage) from terminal 19 may provide the DC bias at the connection, terminal or node 21 for the flame signal which may go to the flame sense A/D converter 22 of the microcontroller 23. Other approaches for providing a variable bias voltage to resistor 18 may be used, such as a D/A converter (not shown) output from processor 23.

When the PWM signal (i.e., an illustrative example of a controlled bias voltage) from terminal 19 toggles at a relatively high frequency (e.g., about 31 kHz) and has a stable duty cycle, a steady DC bias level (e.g., 3 volts as in FIG. 2*e*) may be established at node 21 and across the capacitor 17. If the duty cycle of the PWM signal changes, the DC bias level may change accordingly. The DC bias voltage of node 21, for instance, may be adjusted by varying the duty cycle of the PWM signal of line 19. The low and high voltages of the PWM signal may be zero and five volts, as an example. The PWM signal may be a square wave, which has one portion of the square wave at zero volts and the other portion of the square wave at five volts. A percent duty cycle may equal a portion divided by the sum of portions (i.e., one cycle) which can be multiplied by 100 to get percent. With a constant cycle period (e.g., 1, 2, 3, . . . ) of, for instance, 32 microseconds, and a duty cycle of 50 percent, the five volt portion may be 16 microseconds and the zero portion may be 16 microseconds. If the duty cycle is increased, the five volt portion may be greater than 16 microseconds long and the zero portion may become less than 16 microseconds with the total period of the total cycle being constant at about 32 microseconds. A desired voltage at node 21 may be attained with, for instance, a sixty percent duty cycle (i.e., $V_{node\ 21}=60\%\times V_{cc}$). If the DC bias voltage at node 21 is too high, then processor 23 may reduce the duty cycle of the PWM signal on line 19. If the DC bias voltage at node 21 is too low, then processor 23 may increase the duty cycle of the PWM signal on line 19. A monitoring of the bias voltage to be maintained at a certain magnitude on node 21 may involve a feedback loop via the A/D converter 22, processor 23, line 19 and resistor 18.

If a flame is established, the DC bias may be reduced slightly due to DC current flowing from the node 21. But because resistor 11 normally may be very high in ohms and the bias level low in volts, the flame current 31 generated by a bias voltage while the flame exists may be low but steady. This current may be measured and cancelled.

Leak1 resistance 26 and leak2 resistance 27 may represent the leakage resistances from the node 21 to a DC voltage supply (Vcc) 28 and to a ground terminal 29, respectively. Resistance 26 and resistance 27 not only may affect DC bias at terminal or node 21 connected to the A/D converter 22, but also may affect flame current measurement. Resistance 26 and resistance 27 may effectively provide two paths for some of the current incorporated in the flame current 31, and thus reduce the apparent flame current measurement. An arrow 31 may indicate the direction of the net flame current, along with the effects generated by the high voltage flame sense drive, when switch 14 is operating and a flame exits. If one were to assume that the leakage paths involving leakage resistances 26 and 27 did not exist, as shown in FIG. 1*b*, then all of the flame current may flow through bias resistor 18 and reduce the DC bias at the node 21.

If an A/D sample is taken while switch 14 is chopping and then other sample taken when switch 14 is steady, a voltage differential may be measured and the flame current ($I_{flame}$) calculated with the following formula:

$$I_{flame}=(V_{(switch\ 14\ on)}-V_{(switch\ 14\ off)})/R_{(bias\ resistance\ 18)} \quad (1)$$

where the voltage ($V_{(switch\ 14\ on)}$) is measured when the flame drive source 38 is active (i.e., switch 14 is chopping), and voltage ($V_{(switch\ 14\ off)}$) is measured when the flame drive source 38 is inactive (i.e., switch 14 is steady).

If the leakage paths, such as resistances 26 and 27, exist, as in FIG. 1*a*, then part of the flame current may flow through the leakage paths and the voltage differential caused by the flame current through bias resistor 18 may be reduced due to a lower amount of current (i.e., V=I*R). This may result in a smaller calculated flame current.

As illustrated in FIG. 1*a*, if there is a leakage resistance 26 or leakage resistance 27, or a combined leakage resistance (resistance 26 || resistance 27), then bias resistor 18 may be replaced with an equivalent resistor representing the resistance of bias resistor in parallel with the combined leakage resistance to remove the leakage effect on the flame current calculation. The symbol "||" in an equation may mean that the resistances or resistors associated with the symbol are connected in parallel. A bias resistive combination 33 may include resistances 18, 26 and 27, and node 21.

Normally a bias resistor 18 may be much smaller than the filter resistor 16 plus flame resistor 11, and thus providing somewhat an approach for compensating the effect of the combined leakage resistances. If the flame resistor 11 is very low, for example, less than ten times the bias resistor 18, then the flame current 31 may be slightly over-compensated. However, in the present situation, the flame resistor 11, itself, may be very high and thus the relative inaccuracy may become insignificant.

Figure 3:
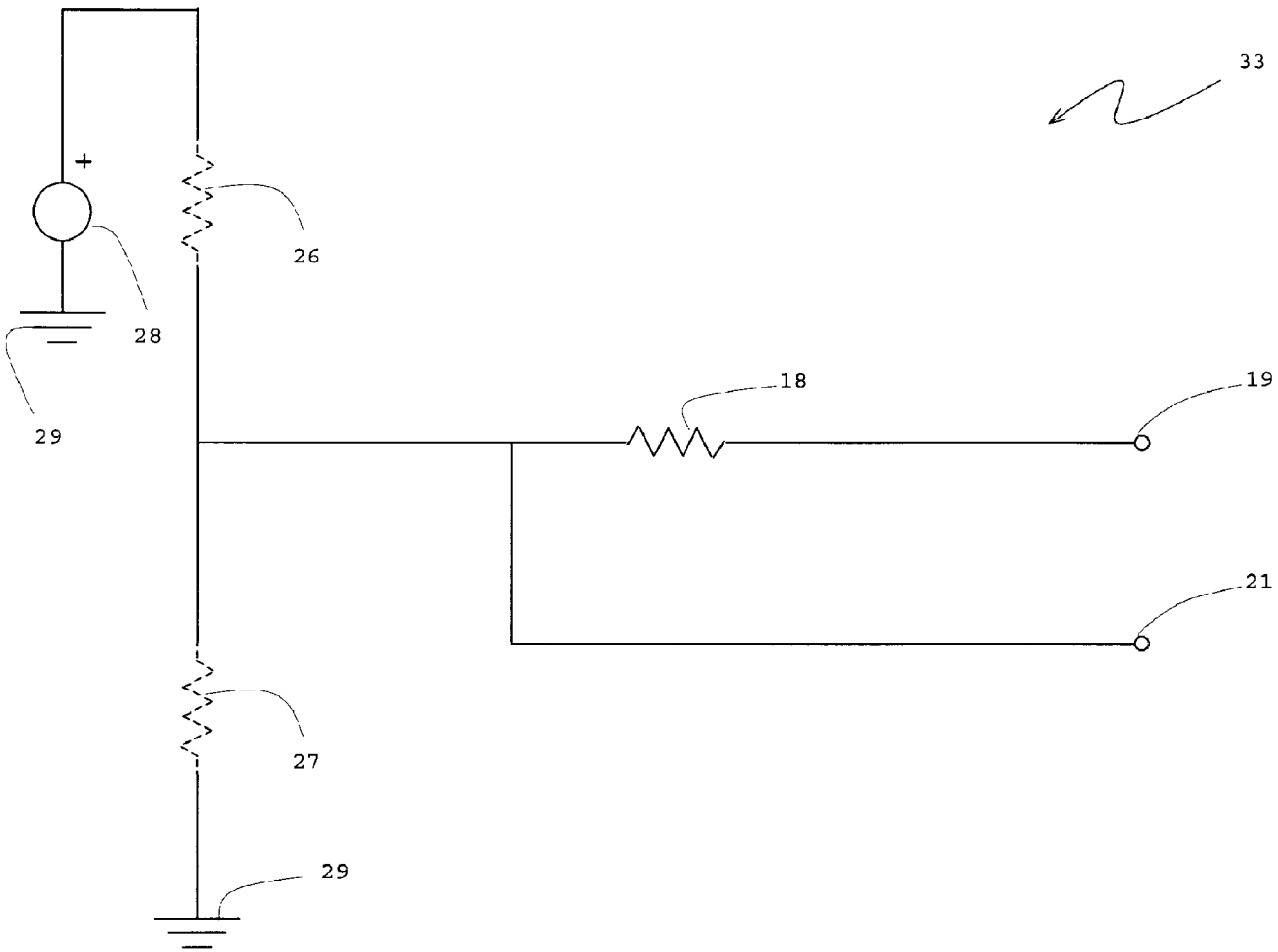
FIG. 3 is a resistance circuit in absence of a detected flame.

FIG. 3 is a simplification of a steady state circuit when a flame is not present. Without the flame, model network 24 likewise is absent from the circuit. Resistance 26 ($R_{leak1}$) may represent the leakage resistance between the node 21 and voltage source ($V_{cc}$) 28. Resistance 27 ($R_{leak2}$) may represent the leakage resistance between the node 21 and ground 29. Resistor 18 may be $R_{bias}$. Resistance 26 and resistance 27 values may be found with the following approach. One may set the PWM output on line 19 to a high state (i.e., 100 percent duty cycle). Then an A/D reading may be taken as $V_{AD}$ (i.e., $V_{cc}$) on node 21, where $$V_{AD}(V_{cc})=V_{cc}\times R_{leak2}/(R_{bias}\|R_{leak1}+R_{leak2}) \quad (2)$$

Then the PWM output on line 19 may be set to ground (i.e., zero percent duty cycle), and an A/D reading as $V_{AD}(G_{rd})$ may be taken, where $$V_{AD}(G_{nd})=V_{cc}\times(R_{bias}\|R_{leak2})/(R_{bias}\|R_{leak2}+R_{leak1}) \quad (3)$$

$R_{leak1}$ and $R_{leak2}$ may be found by solving equations (2) and (3). In practice, calculated $R_{leak1}$ (resistance 26) and $R_{leak2}$ (resistance 27) may be limited to a certain range to avoid over-compensation.

A dynamic bias may be used as an alternative approach to measure flame current when resistance 26 ($R_{leak1}$) and resistance 27 ($R_{leak2}$) are relatively low (e.g., <10×resistance 18 ($R_{bias}$)) and close (e.g., resistance 26 ($R_{leak1}$) in a range of $0.5\times R_{leak2}$ and $2\times R_{leak2}$). In the present case, the leakage may affect the flame current measurement if leakage is not compensated. Instead of determining $R_{leak1/2}$, the bias may be controlled to reduce or eliminate the leakage effect.

While the flame is not present and the flame drive is off, one may: set the PWM output pin or line 19 of processor 23 as an input (high impedance); measure a voltage level ($V_{leak}$) at the A/D line or node 21 (this voltage level may reflect the leakage condition); find a PWM duty cycle so that when the PWM signal is toggling, the A/D pin 21 voltage stays at the same level (Duty cycle=$V_{leak}\times 100\%/V_{cc}$); and when the flame is present and the flame drive 38 is active, the voltage level on line or node 21 may shift lower due to flame current. One may raise the duty cycle to pull the voltage level back to the $V_{leak}$ level or vice versa. The flame current may be calculated from the changed amount of the duty cycle (flame current=duty___increase×$V_{cc}/R_{bias}$). If there is a loss in flame, there may be a large and/or sudden upwards shift in the A/D line or node 21 reading. Thus, flame loss may be quickly detected.

One may also use an extra circuit to structure a PWM which may duty cycle among three states which are output high, output low, and input (high-impedance). The amount of time that the PWM is in a high-impedance state may effectively increase the equivalent bias resistance (resistor 18), and thus change the sensitivity of the flame current measurement. The higher percentage of time of the PWM is in the high-impedance state, the higher may be the equivalent bias resistance, and the higher may be the flame sensing sensitivity.

FIG. 4 represents an implementation of a flame model 24 (when a flame is present) and flame rod 52. In this example, the flame excitation signal may be turned active (chopping) and inactive (steady) periodically to measure the offset in the system (with a positive flame threshold on the A/D terminal or node 21 with no flame present, a DC leakage between the node 21 and ground 29 may look like a valid flame signal). For this reason, the microcontroller or processor 23 should turn off the flame excitation occasionally to determine the correct offset and calibrate to any DC leakage. When the flame excitation signal from the flame excitation block 38 to a DC blocking capacitor 15 has a significant DC component difference (i.e., 75-150 volts) from active to inactive states and there is resistance 41 leakage path across capacitor 15, then the flame sensed on node 21 which is connected to the micro A/D converter 22 may be incorrect. The reason for this problem may be that the leakage across the capacitor 15 injects DC current into the flame model network 24 and the leakage current is well synchronized with the flame excitation state. The invention may solve this problem by implementing a hardware modification with an algorithm.

It may be noted that a resistor 44 may be added to limit current to the flame model network 24 via rod 52. The current limiting may be a safety feature because of the high voltage on the flame rod 52.

Figure 5:
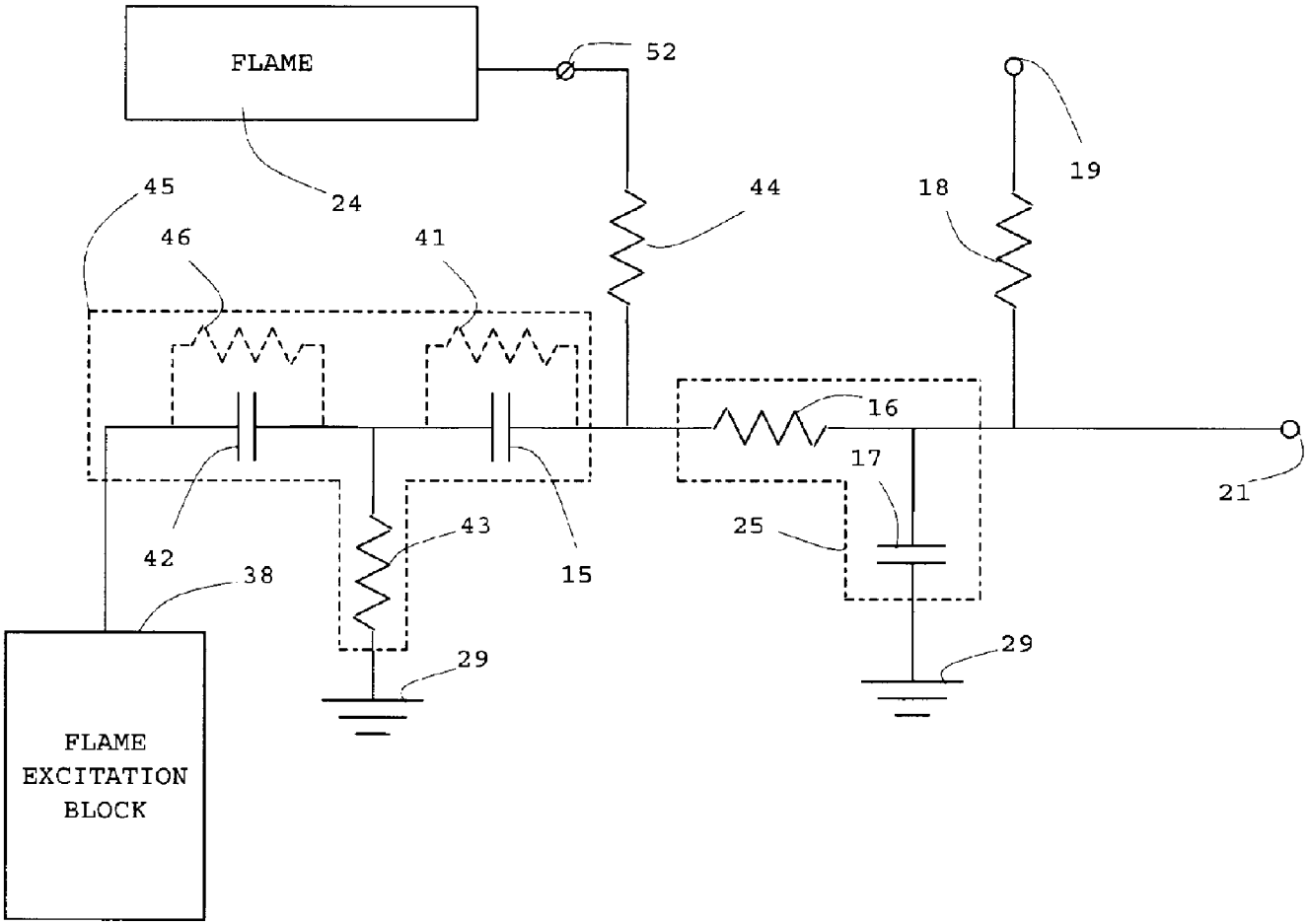
FIG. 5 is like FIG. 4 except the schematic of FIG. 5 has a different DC blocking mechanism.

FIG. 5 illustrates a hardware modification that may allow for reduced sensitivity to DC leakage. This modification may include adding a capacitor 42 and a resistor 43 to the circuit noted in FIG. 4, to greatly reduce sensitivity to leakage, particularly to the leakage through capacitor 15 as represented by resistance 41. If resistance 41 is 100 meg-ohms or lower in the circuit of FIG. 4, the resultant leakage could be intolerable for flame detection. A good capacitor may have a leakage resistance of several giga-ohms. The present modification may maintain a long life of the circuit despite a deterioration of the capacitor or capacitors, or leakage on the printed circuit board surface. Resistor 43 may be about 100 kilo-ohms. One may note that the leakage resistance 46 of capacitor 42 and resistor 43 will form a voltage divider that may significantly reduce the effect of the leakage resistances in the DC blocking network 45. To better improve the situation, one of several control algorithms may be implemented in software, firmware, hardware or another way. One algorithm may be preferred over another, depending on the capabilities of the flame excitation block 38.

In the case of an excitation block 38 where the microcontroller 23 may have full control of the DC voltage on the left-hand side (in FIG. 5) of capacitor 42 proximate to the flame excitation block 38, a fully adjustable flame excitation solution may be easily implemented. When the flame excitation AC signal is off, the DC flame excitation voltage should be driven to the average DC level when the AC drive is on.

Figure 2F:
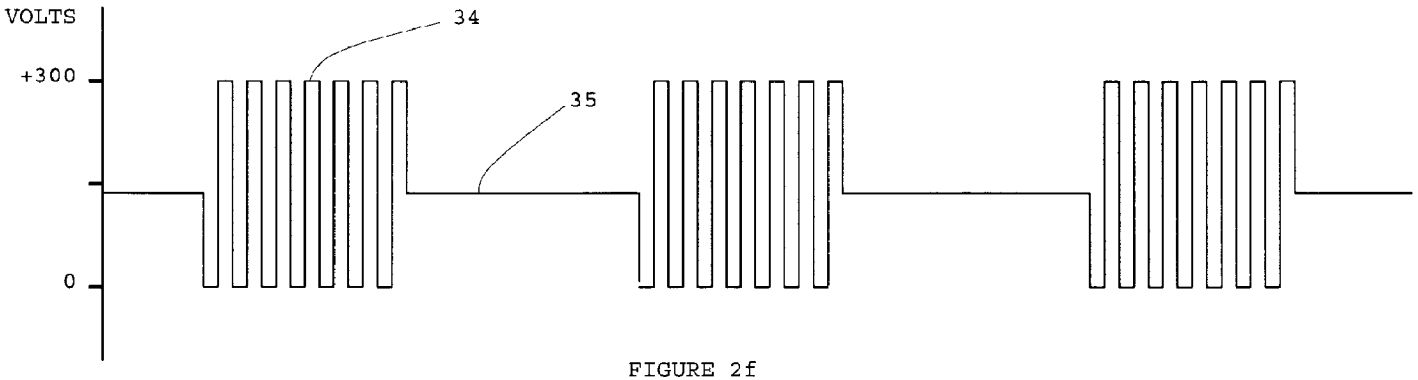
Figure 2G:
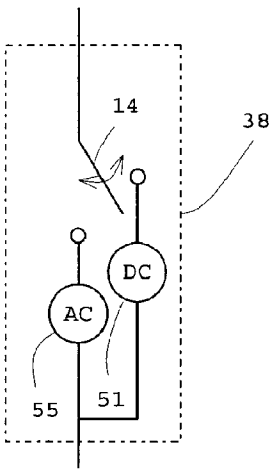
FIG. 2*g* reveals an example of an excitation source for the waveform of FIG. 2*d*.

For example, if the AC voltage from the flame excitation block 38 is a 0-300 volt square wave, then the average DC value may be about 150 volts. When the AC voltage is turned off to measure the offset at node 21, the DC voltage on the flame excitation should be driven to about 150 volts. It may be desirable to drive the voltage to slightly less than 150 volts to ensure that any leakage effect is opposite of the flame current direction; 145 volts may be adequate. FIG. 2*f* shows an example of this waveform.

If advanced diagnostics are needed, the microcontroller 23 may hold the bias level constant and ramp the DC voltage from the excitation source 38 from zero to 300 volts while monitoring the change of voltage on the A/D line or node 21 to obtain a better estimate of leakage in the circuit.

When using a flame excitation source 38 with less capability, a high/low flame excitation algorithm may be utilized. This algorithm may require an excitation block 38 with a voltage which can be adjusted from zero voltage, full voltage, or zero-to-full voltage AC mode. For example, a block 38 may provide 0 volts, 300 volts or a 0 to 300 volt square wave (when the excitation is on). For this algorithm, the DC voltage from the excitation circuit should be set at zero voltage or full voltage while the offset measurements from each state are averaged to wash out any effect of leakage through the DC blocking network 45.

In the present specification, some of the matter may be of a hypothetical or prophetic nature although stated in another manner or tense.

Although the invention has been described with respect to at least one illustrative example, many variations and modifications will become apparent to those skilled in the art upon reading the present specification. It is therefore the intention that the appended claims be interpreted as broadly as possible in view of the prior art to include all such variations and modifications.

What is claimed is:

1. A flame detection system comprising:

a sensing rod;

a filter connected to the sensing rod;

a DC current blocking device connected to the filter and the sensing rod;

an excitation mechanism connected to the DC current blocking device;

a bias impedance connected to the filter; and a variable DC voltage source connected to the bias impedance.

2. The system of claim 1, wherein:

a flame signal from the sensing rod is superimposed on a bias voltage at the bias impedance; and the bias voltage is adjusted by a controller to increase a detectability of the flame signal.

3. The system of claim 2, wherein the detectability of the flame signal is a dynamic range of the system.

4. The system of claim 2, wherein the detectability of the flame signal is a sensitivity of flame sensing.

5. The system of claim 1, wherein an output of the variable DC voltage source can be controlled to be in a low impedance or a high impedance, or any intermediate impedance between the low impedance and the high impedance.

6. The system of claim 5, wherein a flame sensing sensitivity is controlled by adjusting a percentage of time the variable DC voltage source output is in a high-impedance state.

7. A flame detection system comprising:

a sensing rod;

a filter connected to the sensing rod;

a DC current blocking device connected to the filter; and an excitation mechanism connected to the current blocking device.

8. The system of claim 7, wherein the DC current blocking device comprises a capacitor.

9. The system of claim 7, wherein the DC current blocking device comprises:

a first capacitor connected to the low-pass filter;

a second capacitor connected to the first capacitor and to the excitation mechanism.

10. The system of claim 9, wherein the current blocking device further comprises a resistor connected to the first and second capacitors.

11. The system of claim 7, wherein the DC current blocking device comprises:

a plurality of capacitors connected in series;

a resistor connected to a common connection between each pair of capacitors of the plurality of capacitors; and wherein:

the first capacitor of the series is connected to the low pass filter and the last capacitor of the series is connected to the excitation mechanism.

12. A sensing system comprising:

a variable DC voltage source;

a resistance RB connected between the variable DC voltage source and a node;

a possible first leakage resistance RL1 between a first voltage V1 and the node;

a possible second leakage resistance RL2 between a reference voltage and the node;

a voltage indicator connected between the node and the reference voltage; and a process for determining magnitudes of the first resistance RL1 and second leakage resistance RL2.

13. The system of claim 12, wherein the process for determining magnitudes comprises:

setting the variable DC voltage source to the first voltage V1;

noting a second voltage V2 on the indicator;

setting the variable DC voltage source to the reference voltage; and noting a third voltage V3 on the indicator.

14. The system of claim 13, wherein the magnitudes of the first leakage resistance RL1 and the second leakage resistance RL2 are determined by the following equations:

$$V2=V1*RL2/((RB\|RL1)+RL2);\text{ and}$$

$$V3=V1*(RB\|RL2)/((RB\|RL2)+RL1).$$

15. The system of claim 12, wherein the resistance RB is replaced with an equivalent resistor representing the resistance of the resistance RB in parallel with leakage resistance RL1 and leakage resistance RL2.

16. A method for determining and compensating leakage resistance in a circuit, comprising:

providing a variable DC voltage source;

providing a bias resistance connected between the variable DC voltage source and a node;

determining a first leakage resistance between a first voltage and the node;

determining a second leakage resistance between a reference voltage and the node; and replacing the bias resistance with an equivalent resistor representing the resistance of the bias resistance in parallel with the first leakage resistance and the second leakage resistance.

17. A sensing system comprising:

a variable DC voltage source;

a resistance RB connected between the variable DC voltage source and a node;

a possible first leakage resistance RL1 between a first voltage and the node;

a possible second leakage resistance RL2 between a reference voltage and the node;

a voltage indicator connected between the node and the reference voltage;

a flame sensor mechanism connected to the node; and a process for determining a magnitude of a flame current relative to the flame sensor mechanism.

18. The system of claim 17, wherein the process comprises:

putting the flame sensor in a non-flame off state;

setting the variable DC voltage source to a high impedance disabled state;

noting a leakage voltage VL on the indicator;

setting the variable DC voltage source to a low impedance enabled state;

adjusting the variable DC voltage source to attain the voltage VL on the indicator;

putting the flame sensor in a flame on state; and adjusting the variable DC voltage source to attain the voltage VL on the indicator; and wherein:

the DC source is now VL2; and the magnitude of a flame current=|VL2−VL|/RB.

19. A flame sensing system comprising:

a flame excitation block having an output with an adjustable voltage relative to a reference voltage;

a DC blocking device connected to the flame excitation block and a node;

a flame sensing rod connected to the node; and a voltage indicator connected to the node and the voltage reference.

20. The system of claim 19, further comprising:

a variable bias voltage; and a resistor connected between the bias voltage and the node; and wherein the variable bias voltage is adjusted to determine and/or eliminate leakage between the node and the voltage reference.

21. The system of claim 19, further comprising:

a variable bias voltage; and a resistor connected between the bias voltage and the node; and wherein the variable bias voltage is adjusted to determine and/or eliminate leakage between the node and a voltage supply.

22. The system of claim 19, wherein the DC blocking device comprises:

a first capacitor connected between the output of the excitation block, and a second node;

a first resistor connected between the second node and the reference voltage;

a second capacitor connected between the node and the second node.

23. The system of claim 19, further comprising:

a process for determining offset; and wherein the process comprises:

varying a voltage on the output of the flame excitation block from low volts to high volts or vice versa; and monitoring a voltage change on the voltage indicator while varying the adjustable voltage from low volts to high volts or vice versa.

24. The system of claim 23, wherein high is about 300.

25. The system of claim 19, a process for determining offset; and wherein the process comprises:

setting the adjustable voltage on the output of the flame excitation block to a sequence of voltages comprising low volts, an alternating waveform ranging between low volts to a first high volts, and a second high volts; and monitoring voltages on the voltage indicator for the sequence of voltages comprising low volts, an alternating waveform ranging between low volts to the first high volts, and the second high volts.

26. The system of claim 25, wherein the first high is about 300.

27. The system of claim 25, wherein the second high is the same as or slightly lower than the first high.

28. A sensing system comprising:

a variable DC voltage source;

a resistance RB connected between the variable DC voltage source and a node;

a possible first leakage resistance RL1 between a first voltage V1 and the node;

a possible second leakage resistance RL2 between a reference voltage and the node;

a voltage indicator connected between the node and the reference voltage; and a process for determining magnitudes of the first resistance RL1 and second leakage resistance RL2; and wherein:

the process for determining magnitudes comprises:

setting the variable DC voltage source to the first voltage V1;

noting a second voltage V2 on the indicator;

setting the variable DC voltage source to the reference voltage; and noting a third voltage V3 on the indicator; and the magnitudes of the first leakage resistance RL1 and the second leakage resistance RL2 are determined by the following equations:

$$V2=V1*RL2((RB\|RL1)+RL2);\text{ and}$$

$$V3=V1*(RB\|RL2)/((RB\|RL2)+RL1).$$

29. A sensing system comprising:

a variable DC voltage source;

a resistance RB connected between the variable DC voltage source and a node;

a possible first leakage resistance RL1 between a first voltage and the node;

a possible second leakage resistance RL2 between a reference voltage and the node;

a voltage indicator connected between the node and the reference voltage;

a flame sensor mechanism connected to the node; and a process for determining a magnitude of a flame current relative to the flame sensor mechanism; and wherein the process comprises:

putting the flame sensor in a non-flame off state;

setting the variable DC voltage source to a high impedance disabled state;

noting a leakage voltage VL on the indicator;

setting the variable DC voltage source to a low impedance enabled state;

adjusting the variable DC voltage source to attain the voltage VL on the indicator;

putting the flame sensor in a flame on state; and adjusting the variable DC voltage source to attain the voltage VL on the indicator; and wherein:

the DC source is now VL2; and the magnitude of a flame current=|VL2−VL|/RB.

* * * * *